US009739176B2

(12) United States Patent
Aschenbruck et al.

(10) Patent No.: US 9,739,176 B2
(45) Date of Patent: Aug. 22, 2017

(54) TURBOMACHINE

(71) Applicants: Emil Aschenbruck, Duisburg (DE); Jaman El Masalme, Hamminkeln (DE); Michael Blaswich, Oberhausen (DE)

(72) Inventors: Emil Aschenbruck, Duisburg (DE); Jaman El Masalme, Hamminkeln (DE); Michael Blaswich, Oberhausen (DE)

(73) Assignee: MAN Diesel & Turbo SE, Augsburg (DE)

( * ) Notice: Subject to any disclaimer, the term of this patent is extended or adjusted under 35 U.S.C. 154(b) by 359 days.

(21) Appl. No.: 14/520,992

(22) Filed: Oct. 22, 2014

(65) Prior Publication Data

US 2015/0118039 A1 Apr. 30, 2015

(30) Foreign Application Priority Data

Oct. 24, 2013 (DE) ..... 10 2013 017 713

(51) Int. Cl.

| | |
|---|---|
| ***F01D 9/04*** | (2006.01) |
| ***F01D 25/24*** | (2006.01) |
| ***F01D 9/00*** | (2006.01) |
| ***F01D 9/02*** | (2006.01) |

(52) U.S. Cl.

CPC ..... *F01D 25/246* (2013.01); *F01D 9/00* (2013.01); *F01D 9/02* (2013.01); *F01D 9/041* (2013.01); *F01D 9/042* (2013.01); *F05D 2220/32* (2013.01); *F05D 2240/14* (2013.01); *F05D 2240/91* (2013.01)

(58) Field of Classification Search

CPC .... F01D 9/041; F01D 25/246; F05D 2240/14; F05D 2204/91; F05D 2260/30

See application file for complete search history.

(56) References Cited

U.S. PATENT DOCUMENTS

| | | | | |
|---|---|---|---|---|
| 2,766,963 | A | 10/1956 | Zimmerman | |
| 3,824,034 | A | 7/1974 | Leicht | |
| 4,101,242 | A * | 7/1978 | Coplin | F01D 11/18 415/134 |
| 4,208,165 | A | 6/1980 | Wikstrom | |
| 4,953,282 | A | 9/1990 | Corsmeier et al. | |
| 6,126,390 | A | 10/2000 | Böck | |
| 6,783,324 | B2 * | 8/2004 | Muny | F01D 25/246 415/116 |
| 7,094,029 | B2 * | 8/2006 | Taylor | F01D 11/14 415/213.1 |

(Continued)

FOREIGN PATENT DOCUMENTS

| | | |
|---|---|---|
| DE | 2 121 707 B | 11/1972 |
| DE | 21 217 07 | 11/1973 |

(Continued)

*Primary Examiner* — Ninh H Nguyen
(74) *Attorney, Agent, or Firm* — Cozen O'Connor

(57) ABSTRACT

A turbomachine includes: a stator-side housing having: a plurality of stator-side guide vane supports fastened to the stator-side housing, stator-side guide vanes fastened to the stator-side guide vane supports, and axially spaced guide vane rings; and a rotor having a plurality of rotor-side moving blades. At least two guide vane supports are jointly fastened to and centered on a flange of the stator-side housing.

9 Claims, 5 Drawing Sheets

(56) References Cited

U.S. PATENT DOCUMENTS

| | | | | |
|---|---|---|---|---|
| 8,403,636 | B2 * | 3/2013 | Dakowski ..... | F01D 9/04<br>415/173.1 |
| 8,651,809 | B2 | 2/2014 | Ballard, Jr. et al. | |
| 2009/0047126 | A1 | 2/2009 | Ress, Jr. | |

FOREIGN PATENT DOCUMENTS

| | | | |
|---|---|---|---|
| DE | 197 56 734 | | 6/1999 |
| DE | 197 56 734 | A1 | 10/2000 |
| DE | 10 2011 054 389 | A1 | 4/2012 |

* cited by examiner

A - A

TURBOMACHINE

BACKGROUND OF THE INVENTION

1. Field of the Invention

The invention relates to a turbomachine, in particular a gas turbine.

2. Description of the Related Art

It is well known from practice that turbomachines, such as for example gas turbines, have a plurality of stator-side assemblies and a plurality of rotor-side assemblies. The stator-side assemblies of a turbomachine include a stator-side housing, a plurality of stator-side guide vanes being fastened to the stator-side housing via a plurality of stator-side guide vane supports, with formation of axially spaced guide vane rings. Thus, the stator-side guide vane supports are fastened to the housing, the guide vanes being fastened to the guide vane supports and via the guide vane supports to the housing. The rotor-side assemblies of a turbomachine include the rotor-side moving blades, which are fastened to a rotor base body.

In turbomachines known from practice, each guide vane support is connected, via its own separate flange connection, to a corresponding flange of the housing. Particularly when turbomachines are to be provided in a compact design, a close axial and radial layering of the flanges is then required for this. Moreover, the machining of the flanges is expensive.

SUMMARY OF THE INVENTION

Starting with this as the starting point, an object of the present invention is to provide a novel turbomachine.

This object is achieved by a turbomachine in which, in each case, at least two guide vane supports are jointly fastened to and centered on a flange of the housing.

According to an aspect of the present invention, it is proposed that in each case at least two guide vane supports are jointly fastened to and centered on a flange of the stator-side housing of the turbomachine. As a result, the number of required flanges of the housing can be reduced. As a result, the expenditure for machining the housing is reduced. Furthermore, the number of elements required for fastening and centering the guide vane supports can be reduced. When a turbomachine is to be provided in a compact design, constructional space advantages result from the reduced number of flanges of the housing.

Preferably, the guide vane supports are fastened to the respective flange of the housing with the aid of a plurality of connecting elements which extend through flanges of the guide vane supports, which are jointly fastened to and centered on the same flange of the housing, and into the flange of the housing. The connecting elements serve as fastening elements in order to jointly fasten a plurality of guide vane supports on a flange of the housing.

According to an advantageous development, a centering of a first guide vane support on the respective flange of the housing in the axial direction of the turbomachine takes place as a result of a flange of the first guide vane support coming to bear with a first flange surface against a flange surface of the flange of the housing, a centering of a second guide vane support on the same flange of the housing in the axial direction of the turbomachine taking place as a result of a flange of the second guide vane support coming to bear with a flange surface against a second flange surface of the flange of the first guide vane support. As a result, a simple and effective centering of a plurality of guide vane supports jointly on one flange of the housing is possible.

According to a further advantageous development, a centering of a first guide vane support on the respective flange of the housing in the radial direction and the circumferential direction of the turbomachine takes place as a result of at least three first centering elements extending through a flange of the first guide vane support into the flange of the housing, a centering of a second guide vane support on the same flange of the housing in the radial direction and the circumferential direction of the turbomachine taking place as a result of at least three second centering elements extending through a flange of the second guide vane support and the flange of the first guide vane support into the flange of the housing. As a result, a simple radial centering and circumferential centering of a plurality of guide vane supports jointly on one flange of the housing is possible.

Preferably, in the first centering elements and in the second centering elements there are made bore-like cutouts, through which the connecting elements extend. This allows a particularly compact design of the turbomachine.

Preferably, the first centering elements and the second centering elements are in each case uniformly distributed in the circumferential direction. The uniform distribution of the centering elements in the circumferential direction and preferably of the connecting elements in the circumferential direction is preferred for the uniform take-up of forces and moments.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWING

Preferred developments of the invention will become apparent from the following description. An exemplary embodiment of the invention is explained in more detail with the aid of the drawings, without being restricted thereto. In the drawings.

DETAILED DESCRIPTION OF THE PRESENTLY PREFERRED EMBODIMENTS

The present invention relates to a turbomachine 1, in particular a gas turbine.

Figure 1:
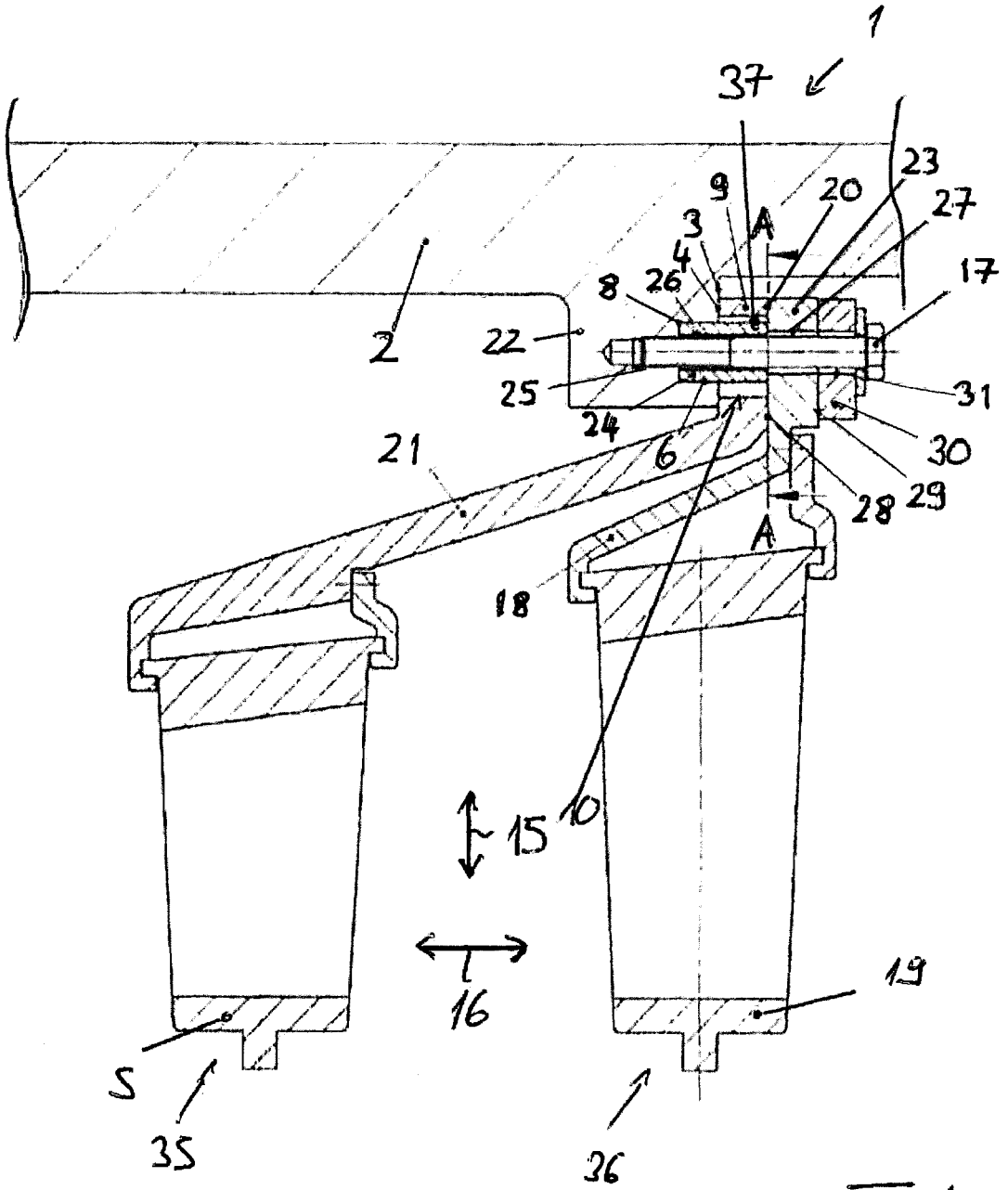
FIG. 1: shows a first detail cross-section in the axial cutting direction through a turbomachine according to the invention, embodied as a gas turbine.
Figure 3:
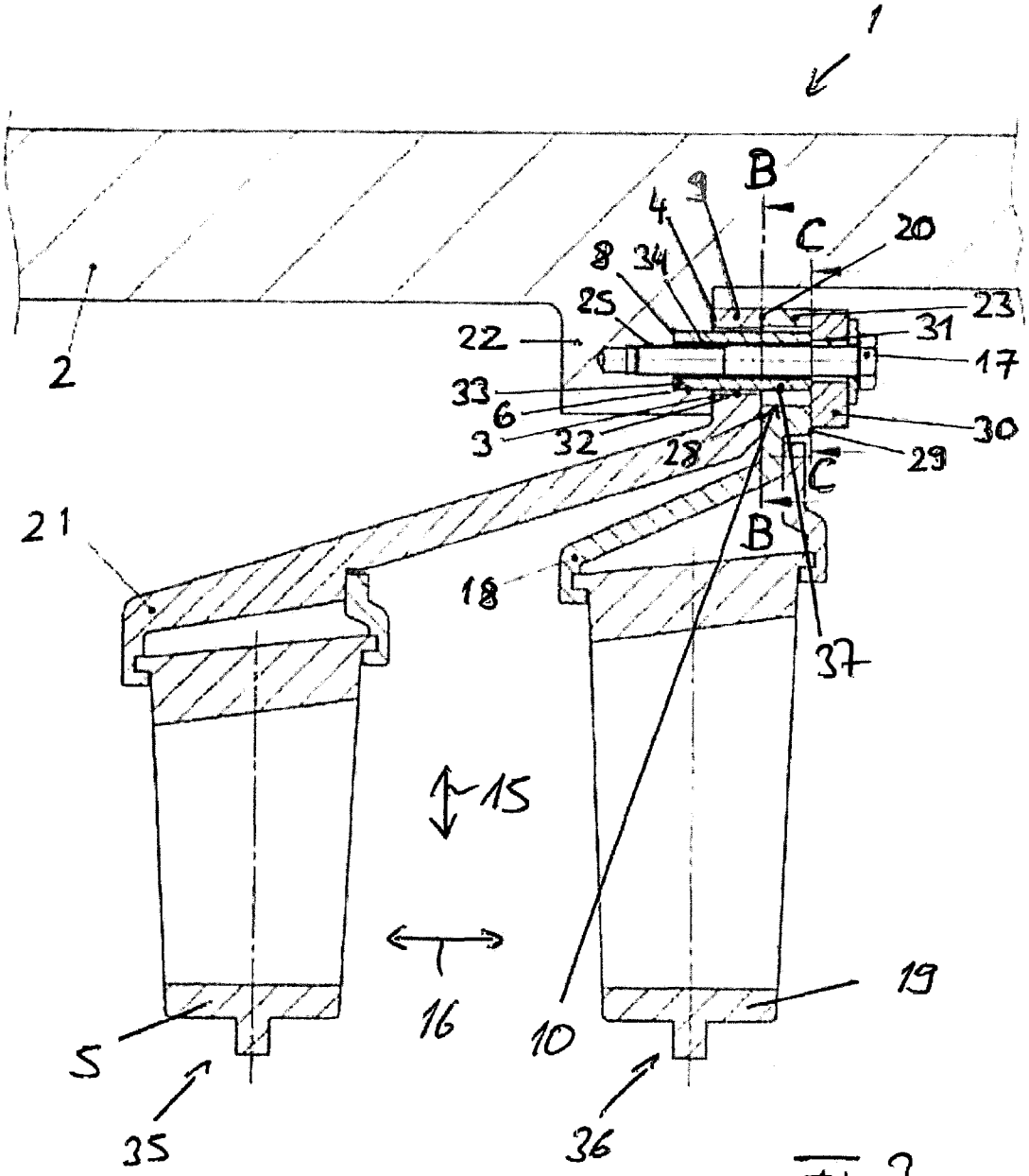
FIG. 3: shows a second detail cross-section in the axial cutting direction through the turbomachine according to the invention, embodied as a gas turbine, which cross-section is offset in the circumferential direction relative to the cross-section of FIG. 1.

FIGS. 1 and 3 each show a cross-section through a turbomachine 1 according to the invention in the axial cutting direction through stator-side assemblies of the turbomachine 1, the sections of FIGS. 1 and 3 being offset in the circumferential direction relative to one another.

Of the stator-side assemblies of the turbomachine 1, in FIGS. 1 and 3 a stator-side housing 2 and stator-side guide vanes 5 and 19 are shown. The stator-side guide vanes 5, 19 are fastened to the housing 2 via guide vane supports 21, 18 in FIG. 1, each of the guide vane supports 21, 18 shown in FIGS. 1 and 3 receiving in each case a plurality of guide vanes 5, 19, with formation in each case of a guide vane ring 35, 36. Thus, the guide vanes 5 received on the guide vane support 21 form the guide vane ring 35 and the guide vanes received on the guide vane support 18 form the guide vane ring 36.

In addition to the guide vane supports 21, 18 and guide vanes 5, 19 shown in FIGS. 1, 3, a turbomachine 1 has a plurality of further such guide vane supports 21, 18 and guide vanes 5, 19 which, viewed in the axial direction 16 of the turbomachine 1, are spaced from the guide vanes 5, 19 shown in FIG. 1.

The turbomachine 1 has, in addition to the stator-side assemblies, rotor-side assemblies, not shown in FIGS. 1, 3, in particular moving blades fastened to a rotor base body.

In the context of the present invention, in each case at least two guide vane supports are jointly fastened to and centered on a flange of the housing 2. Thus, in FIGS. 1, 3 the guide vane supports 21, 18 shown there are jointly fastened to and centered on a flange 22 of the housing 2 of the turbomachine 1. There may also be more than two guide vane supports jointly fastened to and centered on a flange of the housing of the turbomachine.

Serving to fasten the guide vane supports 21, 18 jointly to the flange 22 of the housing 2 are a plurality of connecting elements 17, which extend through flanges 9, 23 of the guide vane supports 21, 18. According to FIGS. 1 and 2, the connecting elements 17 extend through the flanges 9, 23 of the two guide vane supports 21, 18 and into the flange 22 of the housing 2, there being formed on the flange 22 of the housing 2 threaded bores 25, into which the connecting elements 17 formed as fastening screws extend.

A centering of a first guide vane support 21 on the flange 22 of the housing 2 in the axial direction 16 of the turbomachine takes place as a result of the flange 9 of the first guide vane support 21 coming to bear with a first flange surface 4 against a flange surface 3 of the flange 22 of the housing 2.

A centering of the second guide vane support 18 on the same flange 22 of the housing 2 viewed in the axial direction 16 of the turbomachine takes place as a result of the flange 23 of the second guide vane support 18 coming to bear with a flange surface 28 against a second flange surface 20, opposite the first flange surface 4, of the flange 9 of the first guide vane support 21.

Accordingly, the first flange surface 4 of the flange 9 of the first guide vane support 21 contacts the flange surface 3 of the flange 22 of the housing 2. The flange surface 20 of the flange 9 of the first guide vane support 21 contacts the flange surface 28 of the flange 23 of the second guide vane support 18. The flange 9 of the first guide vane support 21 is, accordingly, positioned sandwich-like between the flange 22 of the housing 2 and the flange 23 of the second guide vane support 18.

As can be gathered from FIGS. 1 and 3, a supporting ring 30 comes to bear against a flange surface 29 opposite the flange surface 28 of the flange 23 of the second guide vane support 18, so that, accordingly, the flange 23 of the second guide vane support 18 is positioned sandwich-like between the flange 9 of the first guide vane support 21 and the supporting ring 30. The supporting ring 30 transmits forces exerted by the connecting elements 17 to the flange 23 of the second guide vane support 18.

In addition to this centering of the guide vane supports 21, 18 in the axial direction 16 of the turbomachine, a centering of the guide vane supports 21, 18 takes place in the radial direction 15 and the circumferential direction 12 of the turbomachine. A centering of the first guide vane support 21 on the flange 22 of the housing 2 in the radial direction 15 and the circumferential direction 12 of the turbomachine takes place as a result of at least three first centering elements 24 extending through the flange 9 of the first guide vane support 21 into the flange 22 of the housing 2.

The centering of the second guide vane support 18 on the same flange 22 of the housing 2 in the radial direction 15 and the circumferential direction 12 of the turbomachine 1 takes place as a result of at least three second centering elements 33 extending through the flange 23 of the second guide vane support 18 and the flange 9 of the first guide vane support 21 into the flange 22 of the housing 2.

Each first centering element 24 has a first, cylindrical section 6 which projects into a bore-like cutout 8 in the flange 22 of the housing 2. Via a second section 37, each first centering element 24 projects into a slot-like cutout 10 in the flange 9 of the first guide vane support 21.

Figure 2:
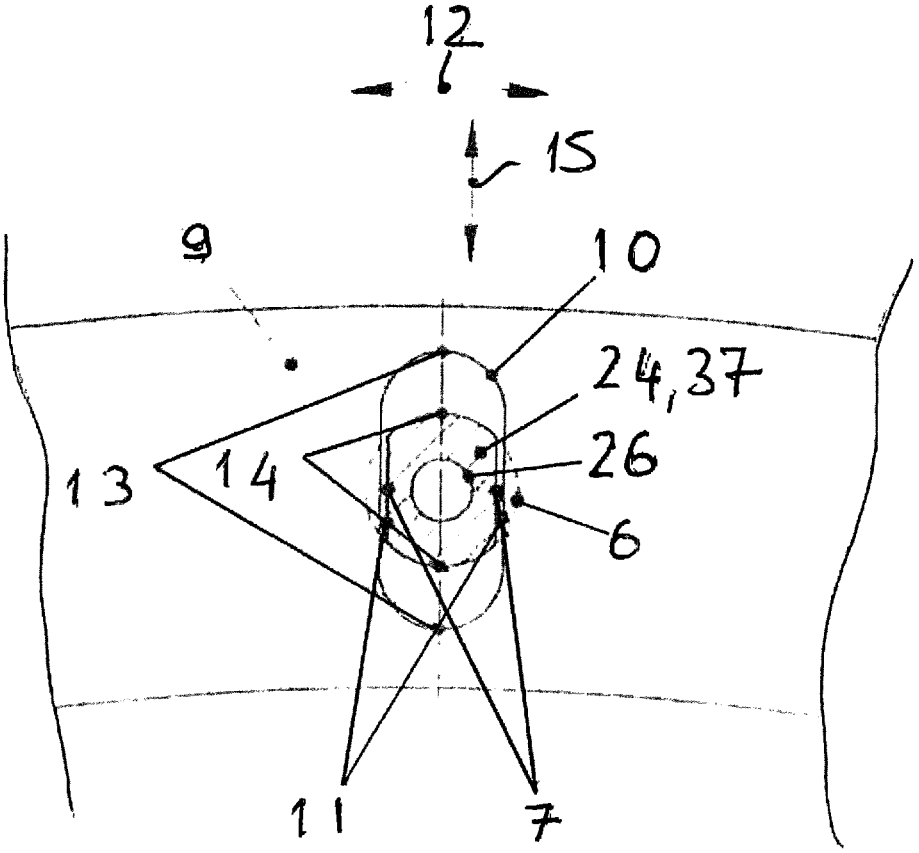
FIG. 2: shows the cross-section A-A of FIG. 1.

As can best be gathered from FIG. 2, the second section 37 of the respective first centering element 24 has a cylindrical basic contour with preferably diametrically opposite flats 7, which run parallel to corresponding surfaces 11 of the slot-like cutout 10 such that a spacing between the flats 7 and the corresponding surfaces 11 of the slot-like cutout 10 allows a defined, minimal relative movement between the first guide vane support 21 and the housing 2 in the circumferential direction 12 of the turbomachine 1.

Extending between the two opposite flats 7 of the cylindrical basic contour of the second section 37 of the respective first centering element 24 are, according to FIG. 2, further surfaces 14 of the second section 37 of the respective centering element 24, these surfaces 14 being arcuately contoured. The slot-like cutout 10 in the flange 9 of the first guide vane support 21 has corresponding surfaces 13 which run relative to the surfaces 14 such that a spacing between the surfaces 13; 14 allows a defined relative movement between the first guide vane support 21 and the housing 2 in the radial direction 15 of the turbomachine 1, in particular in order to compensate for a thermal expansion of the assemblies in the operation of the turbomachine 1.

Each second centering element 33 projects via a first, cylindrical section 6 (see in particular FIGS. 3 and 4) into a bore-like cutout 8 in the flange 22 of the housing 2 and into a bore-like cutout 32 in the flange 9 of the first guide vane support 21. Furthermore, each second centering element 33 has a second section 37, which projects into a slot-like cutout 10 in the flange 23 of the second guide vane support 18 (see FIG. 5).

The second section 37 of each second centering element 33 has in turn a cylindrical basic contour with preferably diametrically opposite flats 7, which run parallel to corresponding surfaces 11 of the slot-like cutout 10 such that a spacing between the same allows a defined minimal relative movement between the second guide vane support 18 and the first guide vane support 21 and thus between the second guide vane support 18 and the housing in the circumferential direction 12 of the turbomachine 1.

Figure 5:
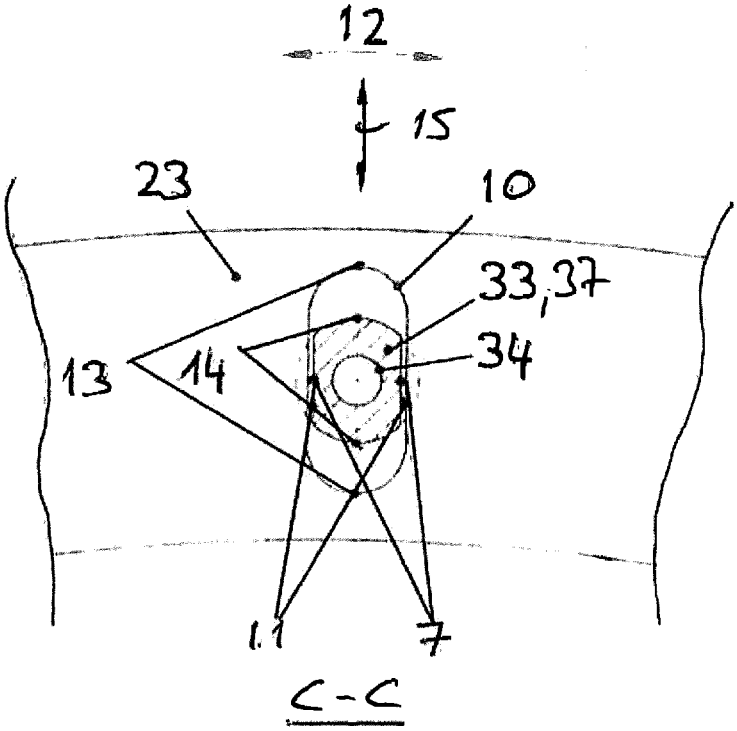
FIG. 5: shows the cross-section C-C of FIG. 3.

Furthermore, the second section 37 of each second centering element 33 has further surfaces 14 which extend between the flats 7 and, according to FIG. 5, in turn are preferably arcuately contoured. These surfaces 14 of the second section 37 of the second centering elements 33 have a spacing, relative to corresponding surfaces 13 of the respective slot-like cutout 10 in the flange 23 of the second guide vane support 18, which is dimensioned such that a defined relative movement is possible between the second guide vane support 18 and the first guide vane support 21 and thus between the second guide vane support 18 and the housing 2 of the turbomachine 1 in the radial direction 15 of the turbomachine, once again in order to compensate for thermal deformations of the assembly in the operation of the turbomachine 1.

As already stated, the connecting elements 17 extend through the two flanges 9, 23 of the two guide vane supports 21, 18. According to FIGS. 1, 3, in the two centering elements 24, 33 there are made, in each case, bore-like cutouts or through-bores 26, 34, through which the connecting elements 17 can extend. Such a through-bore 31 is also made in the supporting rings 30, the connecting elements 17 likewise extending through the through-bores 31 of the supporting rings 30.

At those circumferential positions at which the first centering elements 24 with connecting elements 17 extending through the same are arranged, there are made, in the flange 23 of the second guide vane support 18, through-bores 27 through which the connecting elements 17 can extend. Viewed in the axial direction 16, these through-bores 27 are aligned sectionally with the slot-like cutouts 10 in the flange 9 of the first guide vane support 21.

Figure 6:
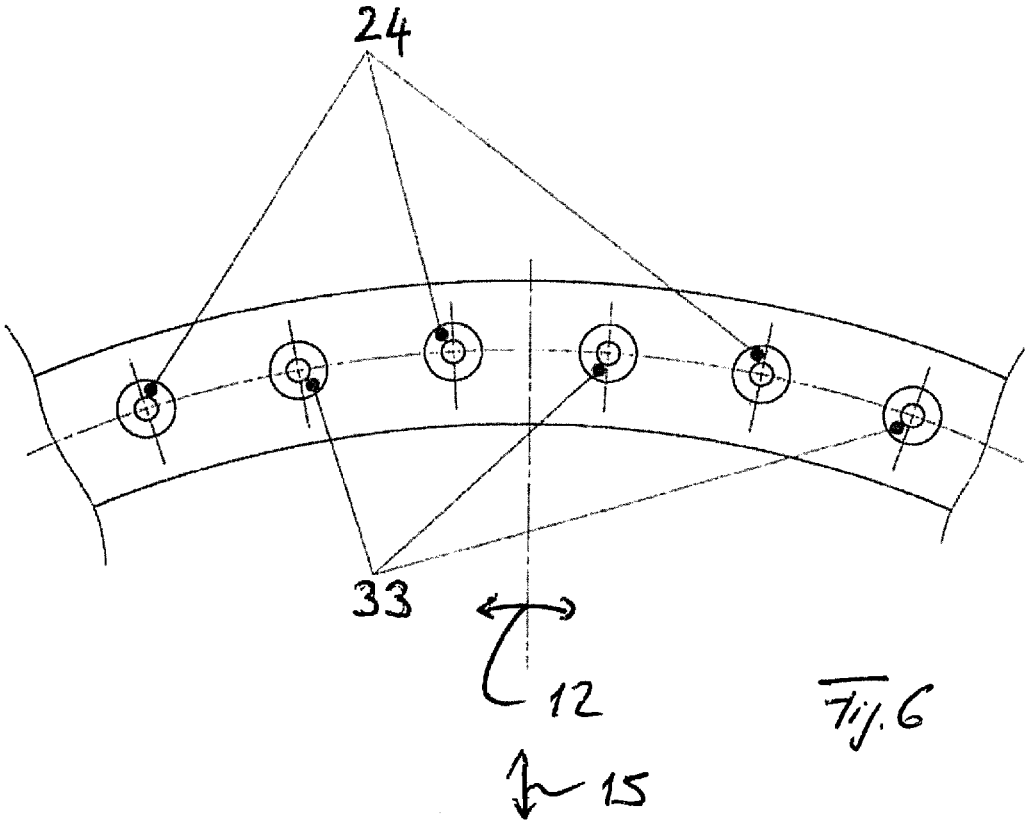
FIG. 6: shows a further detail of the turbomachine according to the invention, embodied as a gas turbine, viewed in the axial direction.

As can best be gathered from FIG. 6, the first centering elements 24 and the second centering elements 33, viewed in the circumferential direction 12, are in each case uniformly distributed.

Accordingly, in the context of the present invention, a plurality of guide vane supports 21, 18 which in each case serve to receive a plurality of guide vanes 5, 19 are to be jointly fastened to and centered on a flange 22 of the housing 2. As a result, the number of the housing-side flanges required for fastening guide vane supports can be reduced compared with the prior art. As a result, the expenditure required for machining such flanges is reduced. Furthermore, the number of fastening elements and centering elements required for the centering and fastening can be reduced.

The centering of the first guide vane support 21 in the radial direction and the circumferential direction takes place via at least three first centering elements 24. The latter project with cylindrical sections 6 into the bores 8 of the flange 22 of the housing 2, there being formed on these bores 8 the threaded bores 25 into which the connecting elements 17 extend with corresponding external thread sections. For the passage of the connecting elements 17, the first centering elements 24 have the through-bores 26. The first centering elements 24 project with their second sections 37 into slots 10 in the flange 9 of the first guide vane support 21, the longitudinal extent of these slots 10 extending in the radial direction 15. Flats 7 on these second sections 37 of the first centering elements 24 run parallel to corresponding surfaces 11 of the slot-like cutouts 10, a spacing between the flats 7 and the surfaces 11 being dimensioned in such a manner that a minimal circumferential movement for compensation for play is possible between the first guide vane support 21 and the housing 2. Surfaces 13, 14, running substantially perpendicularly to these surfaces 7, 11, of the slots 10 and the second sections 37 of the first centering elements 24 have a markedly greater spacing in order to be able to compensate for a temperature-induced expansion of the assemblies in the radial direction in operation. Via the three first centering elements 24, a clearly defined radial centering of the first guide vane support 21 on the housing 2 is ensured. An appreciable displacement of longitudinal center axes of the components relative to one another is therefore not possible. The centering of the second guide vane support 18 on the housing 2 in the radial direction and the circumferential direction takes place substantially analogously thereto, namely via at least three second centering elements 33. First sections 6 of these second centering elements 33 extend into the bore 8 and a through-bore 32 in the flange 9 of the first guide vane support 21, the second sections 37 of the second centering elements 33 extending into the slot-like cutouts 10 in the flange 23 of the second guide vane support 18. The contouring of the second sections 37 of the second centering elements 33 and of the slots 10 in the flange 23 of the second guide vane support 18 corresponds to the contouring of the second sections 37 of the first centering elements 24 and of the slot-like cutouts 10 in the flange 9 of the first guide vane support 21.

In the region of the flange 9 of the first guide vane support 21, the slot-like cutouts 10 and the through-bores 32 are arranged alternately to one another and evenly distributed in the circumferential direction. In the region of the flange 23 of the second guide vane support 18, the slot-like cutouts 10 and the through-bores 27 are alternately arranged and in turn evenly distributed over the circumference.

All the centering elements 24, 33 are provided with through-bores 26, 34 for the passage of the anchoring elements 17.

The axial centering of the two guide vane supports 21, 18 takes place via the flange surfaces 3, 4 coming to bear against one another and the flange surfaces 20, 28 coming to bear against one another, the centering elements 24, 33 extending through the above-mentioned cutouts 10, 27 and 32, 10 in the flanges 9, 23 of the guide vane supports 21, 18 upon assembly.

Figure 4:
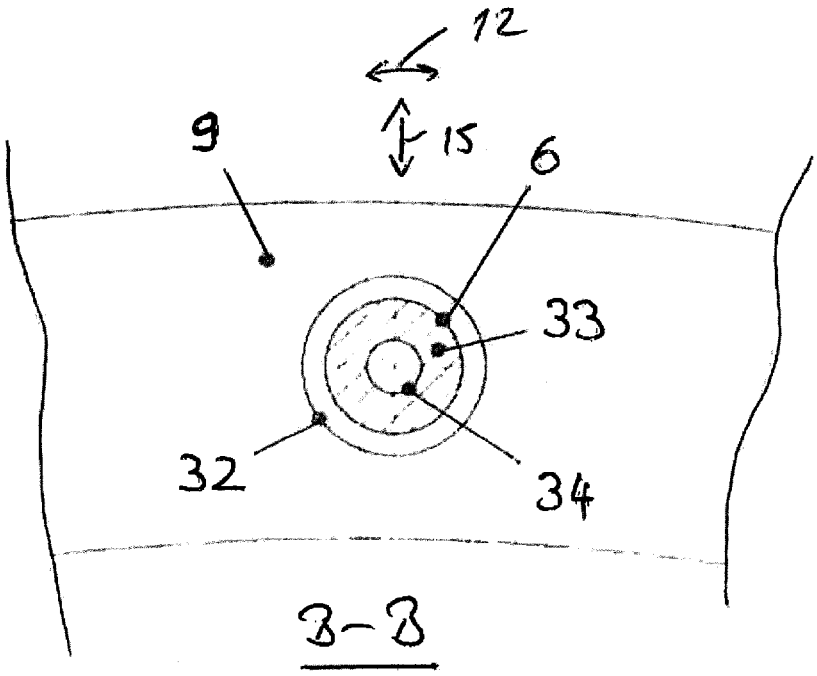
FIG. 4: shows the cross-section B-B of FIG. 3.

As can be gathered from FIG. 4, the diameter of the cylindrical section 6 of the second centering element 33 shown is less than the diameter of the through-bore 32 in the flange 9 of the first guide vane support 21. Analogously, the diameter of the connecting element 17 is less than the diameter of the through-bore 27 in the flange 23 of the second guide vane support 18. As a result, it is possible to compensate for a different thermal expansion of the components in the operation of the turbomachine 1.

The invention enables a compact design of a turbomachine.

A plurality of guide vane supports can be simultaneously fastened to and centered on a flange of a housing of the turbomachine.

As a result, the expenditure for machining corresponding flange surfaces is reduced. Moreover, the number of centering elements and fastening elements required is reduced.

The invention can be used both in the field of turbines and in the field of compressors of a gas turbine or in other turbomachines.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A turbomachine (1) comprising:

a stator-side housing (2), having:

a flange (22), first and second stator-side guide vane supports (21, 18) each being fastened to the stator-side housing (2), the first and second stator-side guide vane supports (21, 18) having respective first and second guide vane support flanges (9, 23), first and second stator-side guide vanes (5, 19) fastened to the first and second stator-side guide vane supports (21, 18), respectively, and first and second axially spaced guide vane rings (35, 36) associated with the first and second stator-side guide vanes (5, 19), respectively; and a rotor having a plurality of rotor-side moving blades, wherein at least two of the first and second stator-side guide vane supports (21, 18) are jointly fastened to and centered on the flange (22) of the stator-side housing (2), and wherein a centering of a first stator-side guide vane support (21) on the flange (22) of the stator-side housing (2) in the radial direction (15) and the circumferential direction (12) of the turbomachine occurs as a result of a plurality of first centering elements (24) extending through the first guide vane support flange (9) into the flange (22) of the stator-side housing (2), and a centering of a second stator-side guide vane support (18) on the flange (22) of the stator-side housing (2) in the radial direction (15) and the circumferential direction (12) of the turbomachine occurs as a result of a plurality of second centering elements (33) extending through the second guide vane support flange (23) and the first guide vane support flange (9) into the flange (22) of the stator-side housing (2).

2. The turbomachine according to claim 1, wherein the turbomachine is a gas turbine.

3. The turbomachine according to claim 1, wherein the plurality of first centering elements (24) is at least three first centering elements (24) and the plurality of second centering elements (33) is at least three second centering elements (33).

4. A turbomachine (1) comprising:

a stator-side housing (2), having:

a flange (22), first and second stator-side guide vane supports (21, 18) each being fastened to the stator-side housing (2), the first and second stator-side guide vane supports (21, 18) having respective first and second guide vane support flanges (9, 23), first and second stator-side guide vanes (5, 19) fastened to the first and second stator-side guide vane supports (21, 18), respectively, and first and second axially spaced guide vane rings (35, 36) associated with the first and second stator-side guide vanes (5, 19), respectively;

connecting elements (17); and a rotor having a plurality of rotor-side moving blades, wherein at least two of the first and second stator-side guide vane supports (21, 18) are jointly fastened to and centered on the flange (22) of the stator-side housing (2), wherein the first and second stator-side guide vane supports (21, 18) are fastened to the flange (22) of the stator-side housing (2) by the connecting elements (17) extending through the respective first and second guide vane support flanges (9, 23), which are jointly fastened to and centered on the flange (22) of the stator-side housing (2), and into the flange (22) of the stator-side housing (2), wherein a centering of the first stator-side guide vane support (21) on the flange (22) of the stator-side housing (2) in the axial direction (16) of the turbomachine occurs as a result of a first surface (4) of the first guide vane support flange (9) coming to bear against a surface (3) of the flange (22) of the stator-side housing (2), and a centering of the second stator-side guide vane support (18) on the flange (22) of the stator-side housing (2) in the axial direction (16) of the turbomachine occurs as a result of a flange surface (28) of the second guide vane support flange (23) coming to bear against a second flange surface (20) of the first guide vane support flange (9), and wherein a centering of a first stator-side guide vane support (21) on the flange (22) of the stator-side housing (2) in the radial direction (15) and the circumferential direction (12) of the turbomachine occurs as a result of at least three first centering elements (24) extending through the first guide vane support flange (9) into the flange (22) of the stator-side housing (2), and a centering of a second stator-side guide vane support (18) on the flange (22) of the stator-side housing (2) in the radial direction (15) and the circumferential direction (12) of the turbomachine occurs as a result of at least three second centering elements (33) extending through the second guide vane support flange (23) and the first guide vane support flange (9) into the flange (22) of the stator-side housing (2).

5. The turbomachine according to claim 4, wherein each first centering element (24) projects, via a first cylindrical section (6), into a bore-like cutout (8) in the flange (22) of the stator-side housing (2), and each first centering element (24) projects with a second section (37) into a slot-like cutout (10) in the first guide vane support flange (9), the second section (37) of each first centering element (24) having a cylindrical basic contour with opposite flats (7) which run parallel to corresponding surfaces (11) of the slot-like cutout (10) such that a distance therebetween allows a defined relative movement between the first stator-side guide vane support (21) and the stator-side housing in the circumferential direction (12) of the turbomachine, and the second section (37) of each first centering element (24) having further surfaces (14) which extend between the flats (7) and run relative to corresponding surfaces (13) of the respective cutout (10) such that a spacing therebetween the allows a defined relative movement between the first stator-side guide vane support (21) and the stator-side housing (2) in the radial direction of the turbomachine.

6. The turbomachine according to claim 5, wherein each second centering element (33) projects, via a first cylindrical section (6), into the bore-like cutout (8) in the flange (22) of the stator-side housing (2) and a bore-like cutout (32) in the first guide vane support flange (9), and each second centering element (33) projects with the second section (37) into a slot-like cutout (10) in the flange (23) of the second stator-side guide vane support (18), the second section (37) of each second centering element (33) having a cylindrical basic contour with opposite flats (7) which run parallel to corresponding surfaces (11) of the slot-like cutout (10) such that a spacing therebetween allows a defined relative movement between the second stator-side guide vane support (18) and the stator-side housing (2) in the circumferential direction (12) of the turbomachine, and the second section (37) of each second centering element (33) having further surfaces (14) which extend between the flats (7) and run relative to corresponding surfaces (13) of the respective slot-like cutout (10) such that a spacing therebetween allows a defined relative movement between the second stator-side guide vane support (18) and the stator-side housing (2) in the radial direction (15) of the turbomachine.

7. The turbomachine according to claim 6, wherein, in each first centering element (24) and in each second centering element (33), bore-like cutouts (26, 34) are provided, through which the connecting elements (17) extend.

8. The turbomachine according to claim 7, wherein the first centering elements (24) and the second centering elements (33) are uniformly distributed in the circumferential direction (12).

9. The turbomachine according to claim 4, wherein the turbomachine is a gas turbine.

* * * * *